US008297162B2

(12) United States Patent
Fournier

(10) Patent No.: US 8,297,162 B2
(45) Date of Patent: Oct. 30, 2012

(54) METHOD AND A DEVICE FOR IDENTIFYING AND NEUTRALIZING AN UNDERSEA MINE

(75) Inventor: Jean-Claude Fournier, Gassin (FR)

(73) Assignee: DCN, Paris (FR)

( * ) Notice: Subject to any disclaimer, the term of this patent is extended or adjusted under 35 U.S.C. 154(b) by 388 days.

(21) Appl. No.: 11/794,106

(22) PCT Filed: Feb. 1, 2006

(86) PCT No.: PCT/FR2006/000222

§ 371 (c)(1),
(2), (4) Date: Jun. 25, 2007

(87) PCT Pub. No.: WO2006/090040

PCT Pub. Date: Aug. 31, 2006

(65) Prior Publication Data

US 2008/0041264 A1 Feb. 21, 2008

(30) Foreign Application Priority Data

Feb. 21, 2005 (FR) ..... 05 01735

(51) Int. Cl.
*F41F 5/00* (2006.01)

(52) U.S. Cl. ..... 89/1.13; 86/50; 102/403

(58) Field of Classification Search ..... 102/402, 102/403; 89/1.13; 86/50
See application file for complete search history.

(56) References Cited

U.S. PATENT DOCUMENTS

| | | | | |
|---|---|---|---|---|
| 3,469,229 | A * | 9/1969 | Pure et al. | 367/6 |
| 3,880,103 | A * | 4/1975 | Talkington | 405/185 |
| 4,641,290 | A * | 2/1987 | Massa et al. | 367/106 |
| 5,121,366 | A * | 6/1992 | Wayner et al. | 367/134 |
| 5,614,907 | A * | 3/1997 | Kreitmair-Steck et al. | 342/25 F |
| 5,661,258 | A * | 8/1997 | Garcia et al. | 102/402 |
| 5,699,318 | A * | 12/1997 | Fischer | 367/88 |
| 6,095,078 | A | 8/2000 | Adams | |
| 6,319,079 | B1 * | 11/2001 | Cooper | 440/12.5 |

FOREIGN PATENT DOCUMENTS

| | | |
|---|---|---|
| EP | 0 547 937 A1 | 6/1993 |
| EP | 0 612 656 A1 | 8/1994 |

OTHER PUBLICATIONS

US 6,308,633, 10/2001, Grosch et al. (withdrawn)

* cited by examiner

*Primary Examiner* — Daniel Troy
(74) *Attorney, Agent, or Firm* — Young & Thompson

(57) ABSTRACT

A method of identifying and optionally neutralizing an undersea object (1, 1') that might be an undersea mine and that is of known geographical position, in which an undersea intervention robot (4, 4') is used suspended under an aircraft capable of stationary flight, such as a helicopter (7) or a drone, serving to bring the robot (4, 4') into register with the object (1, 1') for identification and possibly for being neutralized, the object is identified, and optionally it is neutralized.

10 Claims, 3 Drawing Sheets

METHOD AND A DEVICE FOR IDENTIFYING AND NEUTRALIZING AN UNDERSEA MINE

BACKROUND OF THE INVENTION

The present invention relates to identifying and optionally neutralizing an undersea object that might be an undersea mine, the presence of which object has previously been detected and its position determined.

In order to prepare certain military type operations, it can be necessary to clear sea areas that have previously been mined.

In order to clear such areas, the general practice is to perform a first sweep followed by additional clearance for eliminating any mines that might remain after the first sweep. In order to perform the additional clearance, it is necessary to begin by detecting the mines that might be present, to locate their positions, to identify them, and then to destroy them or at least neutralize them.

In order to recognize the presence of mines and locate their positions, it is possible to use robots such as robots that are remotely controlled by cable or automatic undersea vehicles fitted with detector means, in particular acoustic detector means, together with means for determining accurately the positions of the robots, said means being in communication with an accompanying ship.

By way of example, the accurate positioning means can be satellite global positioning systems such as the GPS system, and preferably differential global positioning means, i.e. means that include beacons in positions that are known accurately and that.-serve, by taking a difference, to determine the position of the moving vehicle whose position is to be known accurately at all times.

By way of example, remotely-controlled robots are front sonars carried by mine sweepers, i.e. ships having good ability to withstand shocks.

Automatic undersea vehicles fitted with mine-detection means and means for determining their positions are small submarines of relatively large dimensions, capable of exploring over distances of a few kilometers or a few tens of kilometers. As a result, they can be launched either from land or from an accompanying vessel that does not need to be particularly good at withstanding shocks.

With such devices, objects are detected that resemble mines but that are not necessarily mines (commonly referred to as mine-like objects (MLO)).

In general, such objects are numerous. Thus, before taking action to neutralize them, it is appropriate to begin by identifying them in order to verify that they are indeed mines.

In order to identify and optionally to neutralize or destroy presumed mines that have been located, it is possible to use various means, and in particular self-propelled undersea robots, that may be reusable or for single use only.

However that method presents several drawbacks, in particular the need to launch such robots at a considerable distance away from the mines that are to be destroyed. In addition, unfavorable weather conditions or contrary currents significantly reduce the effectiveness of such devices. This applies in particular when the speeds of contrary currents are close to or greater than the speed of the robots. Under such circumstances, the robots might never reach their targets or might never manage to take up a stable position in the vicinity thereof.

SUMMARY OF THE INVENTION

The object of the present invention is to remedy those drawbacks by providing means for identifying and optionally neutralizing objects that might be undersea mines, said means being capable of approaching an object and of taking up a stabilized position in the vicinity thereof, independently of weather or sea conditions, by using a carrier vehicle that remains outside the zone of action of a mine, if any.

To this end, the invention provides a method of identifying and optionally neutralizing an undersea object that might be an undersea mine and that is of known geographical position, in which method an undersea intervention robot is used that is suspended beneath an aircraft capable of stationary flight, such as a helicopter, whereby the robot is placed in register with the object to be identified, and optionally neutralized, and then the object is identified, and optionally neutralized.

Preferably, by using accurate geographical positioning means, an undersea intervention robot is placed vertically in register with the known geographical position of the undersea object, which robot is suspended from a support cable mounted on a winch carried by an aircraft capable of stationary flight, the undersea intervention robot including at least means for viewing and/or detecting an undersea mine, and optionally means for acting on an undersea mine, said means being connected to control means, the undersea intervention robot having sufficient weight in water to form a stiff pendulum when it is immersed. Thereafter, a winch is used to lower the undersea intervention robot so as to place in the vicinity of the undersea object; the viewing and/or detection means are used to locate the undersea object, and by moving the aircraft capable of stationary flight and by actuating the winch, the intervention robot is placed in a position relative to the undersea object that enables it to be identified and optionally enables the intervention means of the undersea robot to intervene on the undersea object; the viewing means are used to identify the undersea object; optionally, triggering intervention of the intervention means of the undersea intervention robot on the undersea object; and the intervention robot is moved away from the undersea object.

Preferably, the intervention means of the undersea intervention robot comprise at least one means for neutralizing an undersea mine, and the priming of the intervention of the intervention means of the intervention robot consists in placing an undersea mine-neutralization means on the undersea object and in activating a device for controlling the means for neutralizing an undersea mine.

By way of example, the mine-neutralization means comprise a destroying charge, e.g. of the omnidirectional type or of the directed energy type, including means for securing it to the undersea mine.

Preferably, the accurate geographical positioning means comprise differential global positioning means.

The invention also provides a device for implementing the method of the invention that comprises a remotely-controlled pendular undersea intervention robot connected by a suspension cable to a winch suitable for being carried by a transport vehicle, together with control means connected to the robot and to the winch by data and control signal transfer means, the intervention robot including at least means for viewing and possibly means for detecting an undersea object, and at least means for determining the heading of the robot.

Preferably, the robot further includes at least one intervention means for intervening on an undersea mine.

Preferably, at least one viewing means is constituted by a vertical axis TV camera and associated lighting means.

In addition, at least one viewing means comprises at least one TV camera having a viewing axis that slopes relative to the vertical axis, so as to provide a panoramic view, associated with lighting means, and at least one detection means is constituted by a high frequency sonar.

Preferably, the undersea intervention robot includes at least means for stabilizing its heading position and/or its depth position.

The means for stabilizing the heading position may comprise two arms provided with paddles, which arms are horizontally deployable and secured to the vertical shaft of an electric motor, together with means for controlling and regulating the motor.

By way of example, the device associated with accurate positioning means comprises differential global positioning means installed on a transport vehicle of the device, or at least one acoustic locating buoy associated with a responder beacon disposed in the undersea intervention robot and with means providing a connection with operator control and interface means, or even a mine sweeper sonar associated with means for communication with the means for piloting the vehicle transporting the device.

The device may include means for detecting the deflection of the suspension cable relative to the vertical, and connected to the control means, making it possible to estimate the difference between the position of the robot and the position of the transport vehicle.

Preferably, the undersea intervention robot presents specific gravity significantly greater than 1, and has apparent weight when immersed that is sufficient for the device to behave like a pendulum.

The data and control signal transfer means may comprise two portions interconnected by quick-connection means.

In general, the control means comprise electronic and computer means, in particular for servo-control and operator interface purposes, and including means adapted to assist in piloting the transport vehicle, placed close to the means for piloting the transport vehicle.

The control means may include at least servo-control of the winch for piloting the altitude of the undersea intervention robot.

At least one means for intervening on an undersea mine comprises means for releasing at least one undersea mine-neutralization means constituted for example by an undersea mine-destruction charge that may be an omnidirectional explosive charge possibly of annular shape, or that may be a hollow charge provided with at least one means for securing it to an undersea mine, such as an arm that is primed automatically or that is controlled on coming in contact with the mine, optionally fitted with at least one mechanical or magnetic holding means such as a hydrostatic suction cup. The undersea mine-destruction charge generally includes control means for delayed firing, such as a timer, or acoustic primer means operating in a predetermined time window, possibly with security means such as hydrostatic security by pressostat.

Preferably, the device is associated with a transport vehicle that-is an aircraft capable of stationary flight, such as helicopter or a drone.

BRIEF DESCRIPTION OF THE DRAWINGS

The invention is described below in greater detail but in non-limiting manner with reference to the accompanying figures, in which.

DETAILED DESCRIPTION OF THE PREFERRED EMBODIMENTS

Figure 1:
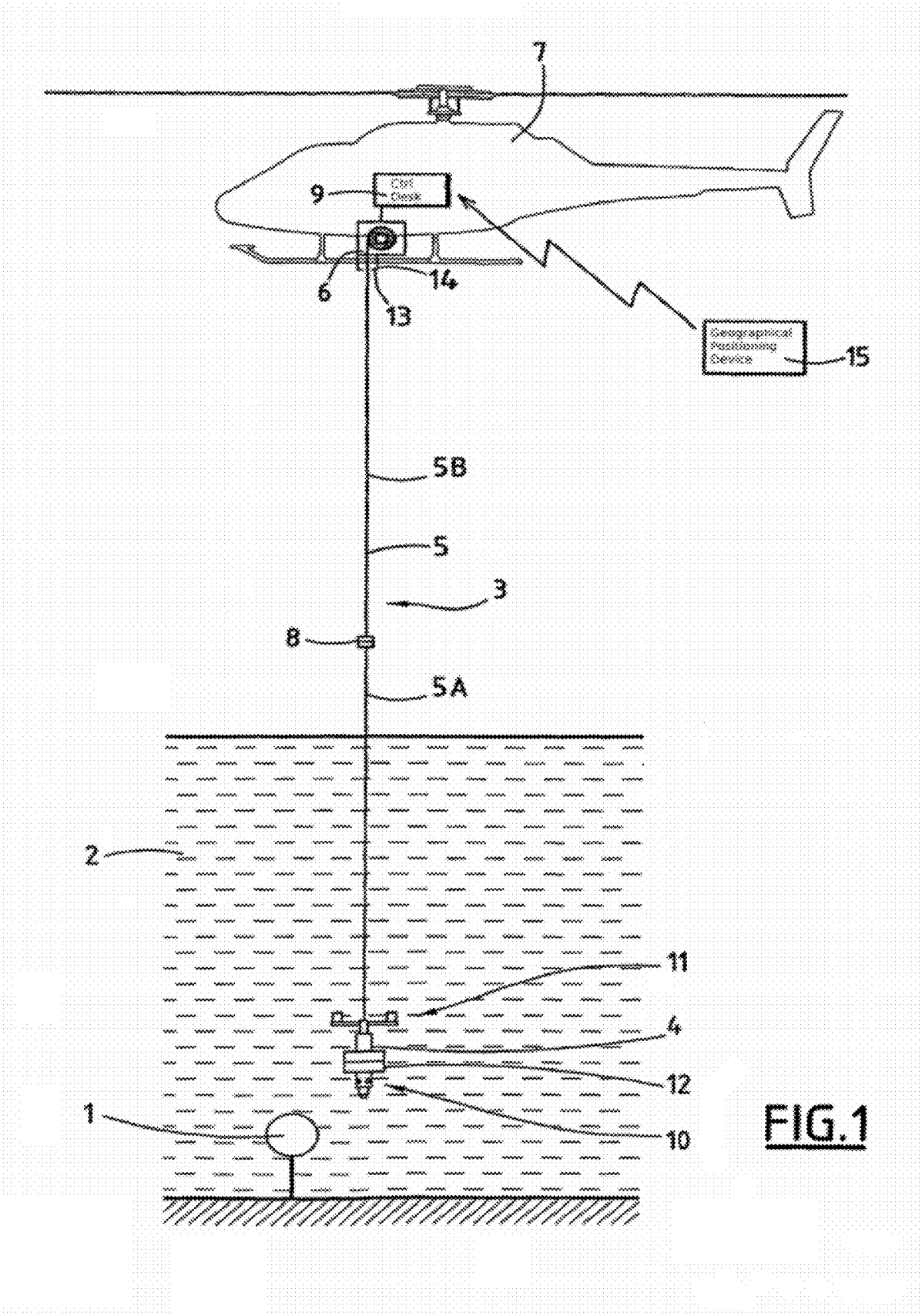
FIG. 1 is a diagram showing a mine-neutralizing device in use.

In order to recognize and destroy an undersea object 1, constituted by an undersea mine placed below the level of the sea 2, used is made of a device given overall reference 3 that is constituted by an undersea intervention robot 4 suspended by a cable 5 from a winch 6 carried by a helicopter 7 equipped so as to be capable of undertaking stationary flight, even in bad weather conditions.

The undersea robot 4 comprises means given overall reference 10 for viewing and detecting a mine, which means are disposed at its bottom portion. It also has means for stabilizing its position under water and given overall reference 11, enabling its heading to be positioned, and also means for positioning it in depth (not visible in the figure). In addition, it carries means 12 for destroying an undersea mine. The robot is made of non-magnetic material and carries sufficiently little electrical or electronic equipment to present a magnetic signature that is weak.

The cable 5 is designed firstly to support the undersea robot 4, and secondly to convey information between the robot 4 and a control desk and operator interface 9 disposed inside the helicopter 7. The cable comprises a final strand 5A and a main strand 5B interconnected by a quick-connection device 8.

The helicopter is fitted at least with means for communicating with accurate geographical positioning means 15.

In order to determine a zone in which potentially dangerous objects have been located, the list of objects to be identified is made available to the pilot of the helicopter, said objects being located by their precise geographical positions, e.g. in the form of readings of their GPS positions. In general, this list will be in the form of a computer file.

Then, with the helicopter and using the accurate geographical positioning means, the undersea robot 4 is transported above the level of the sea until it is vertically over the theoretical position of an object 1 for identification and possible destruction. When the helicopter is in a desired position, the winch 6 is used to lower the undersea robot until it is immersed at a depth that corresponds to the depth at which the object for identification is supposed to be located. Using the viewing and/or locating means, described in greater detail below, an operator then attempts to identify the object. Once the object has been identified, precise indications are forwarded to the pilot, or more generally to the helicopter piloting means, so that by moving the helicopter and possibly also acting on the winch, the undersea robot 4 is moved closer to the object so that the viewing means of the robot can see the object 1 sufficiently well to enable it to be identified. This visual identification may be assisted by specialized image-analysis software.

Once the object 1 has been identified, and found to be a mine, the operator sends an instruction to the undersea robot 4 to place on the mine at least one mine-neutralization means 12, e.g. constituted by an explosive charge, and engages firing means including at least a time delay. Once the firing means of the mine-neutralizing means have been engaged, the operator causes the undersea intervention robot 4 to be raised by winding in the cable 5 onto the winch 6 so as to extract it from the water and take it away from the zone in which the mine might explode.

The helicopter is then moved away from the zone in which the mine is located and can either return to base or else act to identify and possibly destroy another object.

Since the helicopter is capable of stationary flight and is not subjected to currents in the water, it is easy to bring the robot to the vicinity of the object for identification and to keep it in this position, which is not always possible when using a self-propelled undersea robot.

If the helicopter is flying at an altitude of more than 50 meters (m), and preferably more than 100 m, above the level of the sea, it can be assumed to be out of the range of an undersea mine exploding. The invention can then be performed in complete safety.

For various reasons, the robot might be damaged during a mission. Having a two-part cable enables the damaged robot to be replaced by a new robot, without it being necessary to change the entire cable.

The means for viewing and/or detecting mines are firstly one or more miniature TV cameras accompanied by lighting means, and secondly an optional high frequency sonar.

The TV cameras, described in greater detail below, are intended to observe the vicinity of the undersea intervention robot 4 at least in a field of view that is defined relative to the vertical either by a cone having an angle at the apex of about 45°, or by a panoramic field of view making it possible to observe the sea in a hemisphere beneath a horizontal plane.

All of the cameras are fitted with lighting means so as to be capable of seeing at relatively great depths, and over distances of up to about 10 m.

The viewing and detection means may also include a high frequency sonar so as to be capable of detecting objects in the vicinity of the robot at distances that may lie in the range about 20 m to about 100 m, i.e. distances that are significantly greater than the distances accessible to viewing using TV cameras.

In addition to these recognition and detection means, the undersea intervention robot 4 includes means for detecting its heading, necessary for defining the coordinates of objects it might identify. These heading detection means incorporate a magnetic compass, for example.

In order to make the viewing and detection means easier to use, the undersea intervention robot 4 is fitted with position stabilizer means 11 which, in particular, are means for stabilizing its heading by preventing the robot from rotating about its vertical axis. In the absence of such means, the robot suspended at the end of a long cable would tend to spin, thus making it very difficult to make use of the images and requiring complex means for continuously measuring the orientation of the detector means relative to a determined heading.

These heading stabilizer means are themselves known, being constituted in particular by paddles mounted at the ends of horizontal arms themselves mounted on a motor having a vertical axis, with the movement of the motor being servo-controlled to the orientation of a reference point of the robot as measured relative to a heading determined by the heading measurement means.

In order also to make it easier to locate and observe the object that is to be identified, the robot is stabilized in depth by using measurements that may be the position of the robot relative to the bottom of the sea as measured using a sounder, or the position of the robot relative to the surface of the sea as measured by measuring pressure. These measurements are used to control the winch so as to servo-control the length of the cable to keep the robot in a precise position.

The position of the object 1 is located relative to its absolute geographical position, and likewise the position of the helicopter 7 is also determined by its absolute geographical position. It is thus possible to place the undersea intervention robot 4 over the object 1 by causing the absolute geographical positions of the object 1 and of the helicopter 7 to coincide in the absence of current.

Nevertheless, if the zone in which the object is located is a zone through which currents flow, the robot 4 can be entrained by the current so that the support cable 5 is no longer vertical. When the robot 4 is close to the object 1, the helicopter is no longer vertically above the object 1. In order to compensate for these effects due to current and to make the robot 4 easier to position relative to the object 1, it is possible to measure the deflection of the cable 5 relative to the vertical by means of detectors 13 placed in a pod 14 situated under the winch 6.

As mentioned above, the device is associated with accurate geographical positioning means 15. These accurate geographical positioning means 15 are constituted in particular by differential accurate geographical positioning means (differential GPS) that enable the pilot of helicopter to know the position of the aircraft accurately. Such absolute or differential accurate positioning geographical means, are themselves known.

Several embodiments and implementations are possible.

In a first embodiment and implementation, the accurate geographical position of the object 1 is determined using accurate differential geographical positioning means. The coordinates of the object are then sent to the helicopter. On the basis of this data and on the basis of information coming from the accurate geographical positioning system of the helicopter, and possibly also on the basis of information coming from the sensor 13 for sensing deflection of the cable from the vertical, the pilot brings the robot to a position vertically over the object 1.

In a second embodiment and implementation, acoustic positioning beacons are previously placed in the vicinity of the object and a responding beacon is placed on the undersea intervention robot 4.

The acoustic positioning beacons, which are preferably at least three in number, serve to determine accurately the position of the undersea intervention robot by means of the interfaces with the responder beacon of the robot.

This accurate position of the robot is sent to data processor means, e.g. located on an accompanying ship situated at a certain distance. The data is converted into positioning setpoints sent to the helicopter, which applies these new setpoints using its own differential accurate geographical positioning means.

In a third embodiment, the relative position of the object 1 relative to the robot 4 is determined with the sonar of an-accompanying mine sweeper ship which transmits the corresponding data by radio to the helicopter.

The vector corresponding to the position difference between the undersea intervention robot 4 and the object 1 is then used by appropriate means to determine adjustments to be made to the helicopter positioning setpoint, which setpoint is then applied by the helicopter pilot.

When the undersea intervention robot 4 has simultaneously a vertical camera, panoramic TV cameras, and a sonar, a search is carried out for the object in the vicinity of its theoretical position by implementing successive steps that are described below.

Firstly, when the robot is at a distance from the object that is too great to enable the object to be seen with the TV cameras, the presence of the object is detected by the high frequency sonar that sends information to the control desk about the distance of the object relative to the robot and the bearing of the object position relative to a reference heading of the robot. The bearing of the object relative to the reference heading is determined using the heading measurement means on board the robot.

With the help of this information, indications are given to the helicopter pilot for moving the helicopter so as to bring the robot closer to the object. Once the robot is sufficiently close to the object, it can be seen by the panoramic TV cameras which are then used for locating it. Possibly with the help of image analysis software, indications are deduced from the images about the displacements that the helicopter needs to carry out in order to refine the position of the undersea intervention robot relative to the object, possibly by changing the depth to which it is immersed by taking action with the winch 6.

Once the object is sufficiently visible using the vertical camera, its image is analyzed by the operator who verifies that it is indeed a mine and identifies it. To carry out this analysis, the operator may be assisted by specialized software.

Once the mine has been properly identified, the operator sends an instruction to the robot 4 to place neutralization means on the mine, such as a mine-destruction charge 12, which charge is then primed.

As explained below, the mine-neutralization means are either omnidirectional charges of annular shape that engage on the mine, or hollow charges provided with means for securing them to the mine.

The means for priming these mine-destruction means are constituted, for example, by firing delay timers that provide a sufficient delay between placing the charge on the mine and the charge exploding to enable the robot to be moved away.

In order to improve the safety of the device, the means for priming the mine-destruction or neutralization means may be means for acoustic priming in a predetermined time window, possibly associated with safety means such as hydrostatic safety by pressostat.

The advantage of acoustic primer means in a predetermined time window is that priming is engaged only on receiving an acoustic signal that can be sent at will by an operator, e.g. the operator on board the helicopter. This makes it possible to place neutralization means on a set of mines and then prime them all simultaneously. This also makes it possible for the helicopter to delay or cancel priming the explosion of the mine-destruction device in the event of difficulty, in order to ensure its own safety.

Figure 2:
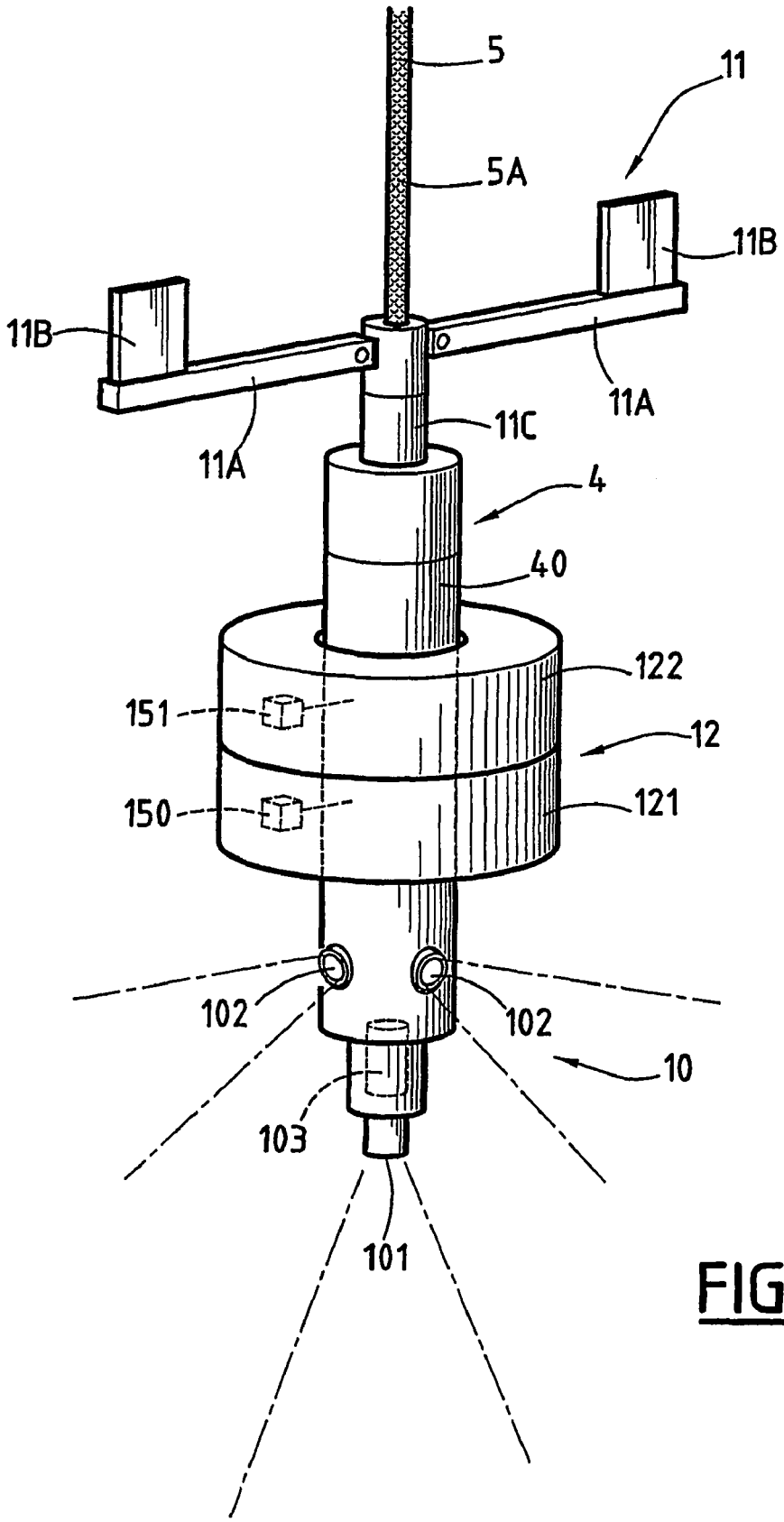
FIG. 2 is a diagrammatic perspective view of a first embodiment of an undersea intervention robot for recognizing and destroying undersea mines.

A first embodiment of an undersea intervention robot as shown in FIG. 2 is described in detail below.

The robot, given overall reference 4, comprises a vertical cylindrical body 40 having, in its top portion, means given overall reference 11, for stabilizing heading, which means are constituted by two moving arms 11A, each having a paddle 11B at its end and connected to the shaft of a motor 11C controlled by regulator means (not shown in the figure) for keeping a reference point of the robot stable on a particular heading. This regulation makes use of a heading measurement device and of means for measuring the angle between the direction of the robot reference point and a reference heading.

The robot is suspended from the bottom strand 5A of a cable 5, as described above, the cable serving firstly to provide mechanical suspension of the robot, and secondly to convey information, and possibly also electrical power between the robot and a control desk.

The bottom portion of the robot body 40 has the viewing and locating means given overall reference 10 that are constituted by a vertical TV camera 101 accompanied by lighting means looking in a vertical direction, by a plurality of panoramic TV cameras 102 also accompanied by appropriate lighting means, and by a high frequency sonar 103 that is movably mounted so as to be capable of scanning the horizon about the robot 4.

These viewing and locating means are connected to the control desk of the device (not shown in the figure) by means of the cable. The associated minimum amount of electronic equipment is situated inside the body of the robot.

At its periphery, the robot body has means, given overall reference 12, for destroying or neutralizing a mine. These means are constituted by two explosive charges 121 and 122 of annular shape, each having time delay powering means-or firing means that can be primed by an acoustic signal in a time window, said means being identified by references 150 and 151 respectively, the charges being held on the robot by holder means that can be released separately one after the other so as to allow a charge to drop onto a particular mine.

Thus, when the robot is brought over a first mine, the first explosive charge 121 can be released so that it slides along the robot body and becomes deposited on the head of the mine and is held thereon because of its annular shape. This explosive charge can be connected to the robot by a control wire, itself connected via the cable 5A to the control desk of the device, so as to enable the operator to prime the charge-firing means. It is also possible for the charge-firing means (or more precisely its timer) to be primed automatically when the charge is released. In the example described, the robot has two explosive charges, however it could have a larger number.

The robot with two explosive charges 121 and 122 can be used for neutralizing a second mine. Under such circumstances, after placing the first charge 121 on a first mine, the robot is moved so as to bring it above a second mine. The second charge 122 is then released so that it slides along the robot body and becomes deposited on the second mine, and the second charge is primed.

The means for locking and releasing the various means are themselves known and the person skilled in the art can implement them easily, possibly in the form of arms or pegs controlled by electromagnetic actuators.

Although not visible in the figure, the robot contains within its body 40 a source of electricity for the-motor 11C of the heading regulator means and possibly for controlling the means for locking and releasing the explosive charges. This source of electricity may be a battery, for example. The robot may also include means for electrically powering the TV cameras, their lighting means, and the sonar, likewise constituted by batteries. Finally, the robot includes means for determining heading, e.g. a magnetic compass, and means for determining the position of the robot, firstly relative to the sea bottom, e.g. an acoustic sounder, and secondly relative to the surface of the sea, e.g. pressure measuring means. These means also have their electrical power supplies.

In a variant embodiment, the robot may be powered electrically by the cable connecting it to the helicopter.

The robot can be used equally well for neutralizing moored mines and mines placed on the sea bottom.

A second embodiment of the robot is described below with reference to FIGS. 3 and 4.

Figure 3:
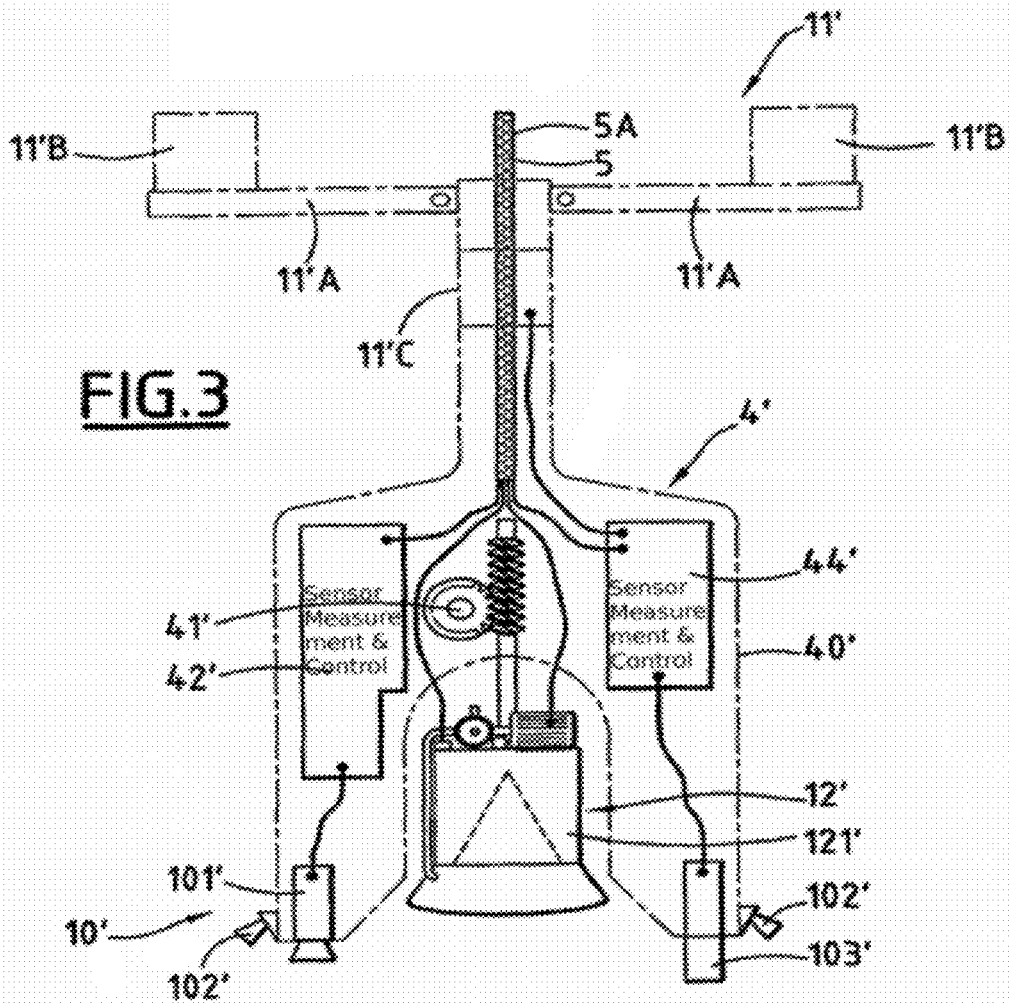
FIG. 3 is a diagrammatic section view of a second embodiment of an undersea intervention robot for destroying an undersea mine, the robot being fitted with a hollow charge.
Figure 4:
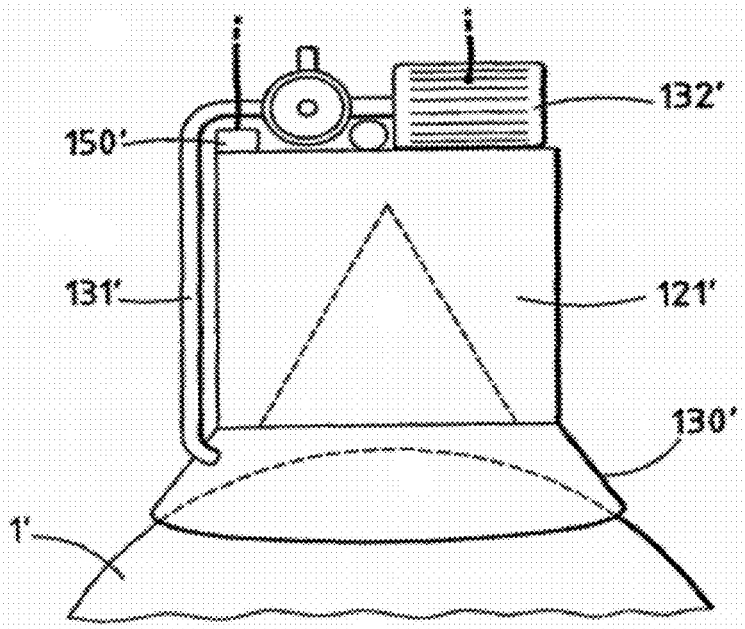
FIG. 4 is a diagrammatic view of a hollow charge for destroying an undersea mine.

The FIG. 3 robot, given overall reference 4', comprises a bell-shaped body 40' whose top surface is fitted with heading stabilizer means 11' identical to the means described in the above embodiment and comprising two hinged arms 11'A carrying paddles 11'B. The robot body is suspended from the bottom strand 5A of a cable 5 identical to the preceding cable. A vertical-viewing TV camera 101', panoramic TV cameras 102', and a high frequency sonar 103' are disposed at the bottom of the body 40'. Electronic and measurement means 42' and 44' are designed to operate the TV cameras 101', 102', the sonar 103', heading measurement means such as a magnetic compass, underwater depth measurement means such as a pressure sensor, and means for measuring distance relative to the bottom, such as a sounder.

The robot body also contains electrical power sources, e.g. batteries, for controlling the TV cameras, the sonars, the other electronic equipment, and also the various motors with which the robot is fitted in order to simplify the design of the cable, of the connectors, and of the rotary connector.

In a variant embodiment, the electrical power supply can be provided from the outside via the cable 5.

In addition to the detection and measurement means, the robot includes inside the bell 40' mine-destruction means 12' constituted by a hollow charge 121' having a time delay primer device 150' and including a hydraulic suction cup for pressing the hollow charge against a moored mine 1'. The hydraulic suction cup is constituted by a skirt 130' connected by a pipe 131' to a pump 132'. The charge 12' is suspended inside the robot by a device 41' that serves to lower the charge and release it and abandon it, pressed against a mine that it is desired to destroy. Unlike the case described above, the robot carries only one hollow charge, and under such circumstances it can destroy only one mine at a time. As in the above-described example, the robot body is made for the most part out of non-magnetic materials and its electrical or electronic equipment is kept to a minimum so as to ensure that the robot presents a magnetic signature that is as weak as possible.

In any event, the electronic equipment disposed inside the robot is equipment that is strictly necessary on board the robot in order to enable it to operate. Other equipment is kept remote from the robot, e.g. in the control desk situated in the helicopter, and is connected to the robot by the cable 5.

Preferably, the robot body and as much of the equipment as possible are made of non-magnetic materials so as to ensure that the magnetic signature is as weak as possible.

In any event, the specific gravity of the robot must be significantly greater than 1 and its apparent weight must be sufficient to ensure that it behaves like a pendulum, but not too heavy so as to remain compatible with use from a helicopter.

In general, the robot does not have its own propulsion means. Nevertheless, it can be useful to provide it with small thrusters, such as propellers, in order to facilitate fine final-approach movements to the position of the mine for destruction. Nevertheless, when such means exist they are completely insufficient to enable the robot to travel on its own.

The control means and operator interface means in the device may include computer means and display means on board the helicopter.

These computer and display means can make use of image analysis and image recognition software in order to make it easier to interpret the TV images. They may also make use of software that makes use of data relating to a mind being detected, to its position, and to the position of the helicopter, in particular data provided by the accurate positioning devices, so as to display setpoints for the helicopter pilot, or even deliver setpoints to an automatic pilot. These means can also provide control signals to the winch and to the helicopter piloting means in order to stabilize the depth of the robot automatically.

This description of the means is not exhaustive and the person skilled in the art knows how to provide such control means and all the necessary automation.

Similarly, the description of the equipment available to the robot is not limiting, and the robot may be fitted with any devices that perform desired functions, providing the characteristics of the devices are compatible with using the undersea robot suspended from a helicopter.

Furthermore, the robot might be designed solely to identify objects that might be mines. Under such circumstances, it does not have means for releasing a mine-destruction charge. If a mine is identified and needs to be destroyed, it can be destroyed by using another robot capable of releasing a mine-destruction charge. Finally, the invention is described as being used from a helicopter. However any aircraft capable of transporting the robot over the sea and of maintaining stationary flight could be used. The aircraft could be piloted equally well by an on-board pilot or under remote control. In particular, the aircraft could be a drone.

The robot can be used and maneuvered by an operator who may possibly be the pilot of the aircraft or who may be a specialist operator.

The pilot of the aircraft and the operator could equally well be located close to each other or far apart. In particular, the automatic responses and the control and interface means with an operator could be located equally well on board the aircraft or on board a support ship or a control station on land that is in radio communication with the aircraft. Under such circumstances, if the aircraft is a helicopter, the pilot and the operator are far apart from each other. Finally, the operator could optionally be replaced by automatic means.

The invention claimed is:

1. A method of identifying an undersea object, comprising:

suspending an undersea intervention robot via a cable from an aircraft configured for stationary flight;

using a geographical positioning device to place the undersea intervention robot vertically over a known geographical position of the undersea object, the undersea intervention robot including a detection device configured to detect an undersea object, said detection device being connected to a control device;

using a winch to lower the undersea intervention robot and submerge the undersea intervention robot beneath the water surface in the vicinity of the undersea object, the undersea intervention robot presenting a specific gravity greater than 1 and presenting a weight, when immersed, such that the cable remains taut and such that the undersea intervention robot exerts a downward force upon the aircraft;

using the detection device to locate the undersea object;

moving the aircraft and actuating the winch to move the submerged intervention robot in a position near to the undersea object to enable the detection device to identify the undersea object;

upon identification of the undersea object as an undersea mine, triggering an intervention device of the undersea intervention robot to interact with the undersea mine; and moving the intervention robot away from the undersea object, wherein the undersea intervention robot comprises:

a vertical cylindrical body with a top portion and a bottom portion, the top portion including a stabilization device, the stabilization device comprising two movable arms, an end of each movable arm having a paddle, and each of the arms actuated by a motor controlled by a regulator device that, in use, keeps a reference point of the robot stable on a pre-determined heading, and the bottom portion comprising the detection device, whereby the detection device is comprised of a vertical TV camera, a vertically directed lighting device, one or more panoramic TV cameras, at least one additional lighting device associated with the one or more panoramic TV cameras, and a high frequency sonar movably mounted to the cylindrical body and configured to, in use, scan a horizon about the intervention robot, wherein the intervention device comprises two explosive charges, each explosive charge having an annular shape and a time delayable firing device primable in a predetermined time window by an acoustic signal, and wherein the explosive charges of the intervention device are held on the intervention robot by a holding device and separately releasable from the intervention robot.

2. The method according to claim 1, wherein a priming procedure of the intervention device comprises the sub-steps of placing one of the two explosive charges on the undersea mine and activating the time delayable firing device.

3. The method according to claim 1, wherein the geographical positioning device comprises a differential global positioning device.

4. The method according to claim 1, wherein each of the explosive charges is one of an omnidirectional charge and a directed energy charge, and includes a device for securing to the undersea mine.

5. The method according to claim 1, wherein the undersea intervention robot is free of a self-propulsion means.

6. A method of identifying an undersea object, comprising:

suspending an undersea intervention robot via a cable from an aircraft configured for stationary flight;

locating, via a geographical positioning device, a known geographical position of the undersea object;

carrying the undersea intervention robot via the aircraft and the cable to the known geographical position;

lowering the undersea intervention robot via a winch onboard the aircraft to immerse the undersea intervention robot beneath the water surface in a vicinity of the undersea object, the intervention robot in connection with a control device on board the aircraft and including a detection device configured to detect an undersea object, the undersea intervention robot presenting a specific gravity greater than 1 and presenting a weight upon the cable such that, while immersed, the weight exerts a downward force upon the aircraft via the cable;

towing the undersea intervention robot, via movement of the aircraft, to place the intervention robot in a position near to the undersea object to enable the detection device to identify the undersea object;

using the detection device of the undersea intervention robot to identify the undersea object;

upon identification of the undersea object as an undersea mine, towing the undersea intervention robot, via movement of the aircraft, to a position directly above the undersea mine, and then triggering an intervention device of the undersea intervention robot to interact with the undersea mine; and towing the undersea intervention robot away, via movement of the aircraft, away from the undersea object, wherein the undersea intervention robot comprises:

a vertical cylindrical body with a top portion and a bottom portion, the top portion including a stabilization device, the stabilization device comprising two movable arms actuated by a motor, an end of each movable arm having a paddle, and the bottom portion comprising the detection device, whereby the detection device is comprised of a vertical TV camera, a vertically directed lighting device, one or more panoramic TV cameras, at least one additional lighting device associated with the one or more panoramic TV cameras, and a high frequency sonar movably mounted to the cylindrical body and configured to, in use, scan a horizon about the intervention robot, wherein the intervention device is suspended from the intervention robot by an extendable device that, in use, extends the intervention device from the intervention robot, the intervention device comprising one or more explosive charges.

7. The method according to claim 6, wherein a priming procedure of the intervention device comprises the sub-steps of placing one of the one or more explosive charges on the undersea mine and activating a time delayable firing device.

8. The method according to claim 6, wherein the geographical positioning device comprises a differential global positioning device.

9. The method according to claim 6, wherein the at least one explosive charge has an annular shape and a time delayable firing device.

10. The method according to claim 6, wherein the intervention device comprises two explosive charges, said explosive charges being held on the intervention robot and separately releasable from the intervention robot.

* * * * *